United States Patent [19]

Talamantez, Sr.

[11] Patent Number: 4,693,476

[45] Date of Patent: Sep. 15, 1987

[54] BALL-AND-TARGET GAME WITH TILTABLE PLAYING SURFACE THEREFOR

[76] Inventor: Rudolph Talamantez, Sr., 9 Oldham Rd., Silver Spring, Md. 20901

[21] Appl. No.: 873,097

[22] Filed: Jun. 5, 1986

Related U.S. Application Data

[63] Continuation of Ser. No. 596,849, Apr. 4, 1984, abandoned.

[51] Int. Cl.[4] ..... A63F 7/00

[52] U.S. Cl. ..... 273/110; 434/201; 434/209

[58] Field of Search ..... 273/3 B, 85 A, 109, 273/110, 121 A, 138 A; 434/191, 201, 209

[56] References Cited

U.S. PATENT DOCUMENTS

| | | | |
|---|---|---|---|
| 4,017,077 | 4/1977 | Burnside | 273/121 A |
| 4,030,555 | 6/1977 | Boyce et al. | 273/110 |
| 4,176,844 | 12/1979 | Ryan et al. | 273/121 A |
| 4,322,612 | 3/1982 | Lange | 273/138 A |
| 4,363,485 | 12/1982 | Edwall | 273/121 A |

OTHER PUBLICATIONS

"Playmeter", 4–82, pp. 80–92.

*Primary Examiner*—Richard C. Pinkham
*Assistant Examiner*—MaryAnn Stoll Lastova
*Attorney, Agent, or Firm*—James A. Wong

[57] ABSTRACT

An apparatus of the kind for playing programmable electronic data games, comprising structure for interchanging programmable data and, recording the same on visual displays, a device for printing out data information, and mechanism for a skillful operator to manipulate the apparatus to perform various given functions.

5 Claims, 5 Drawing Figures

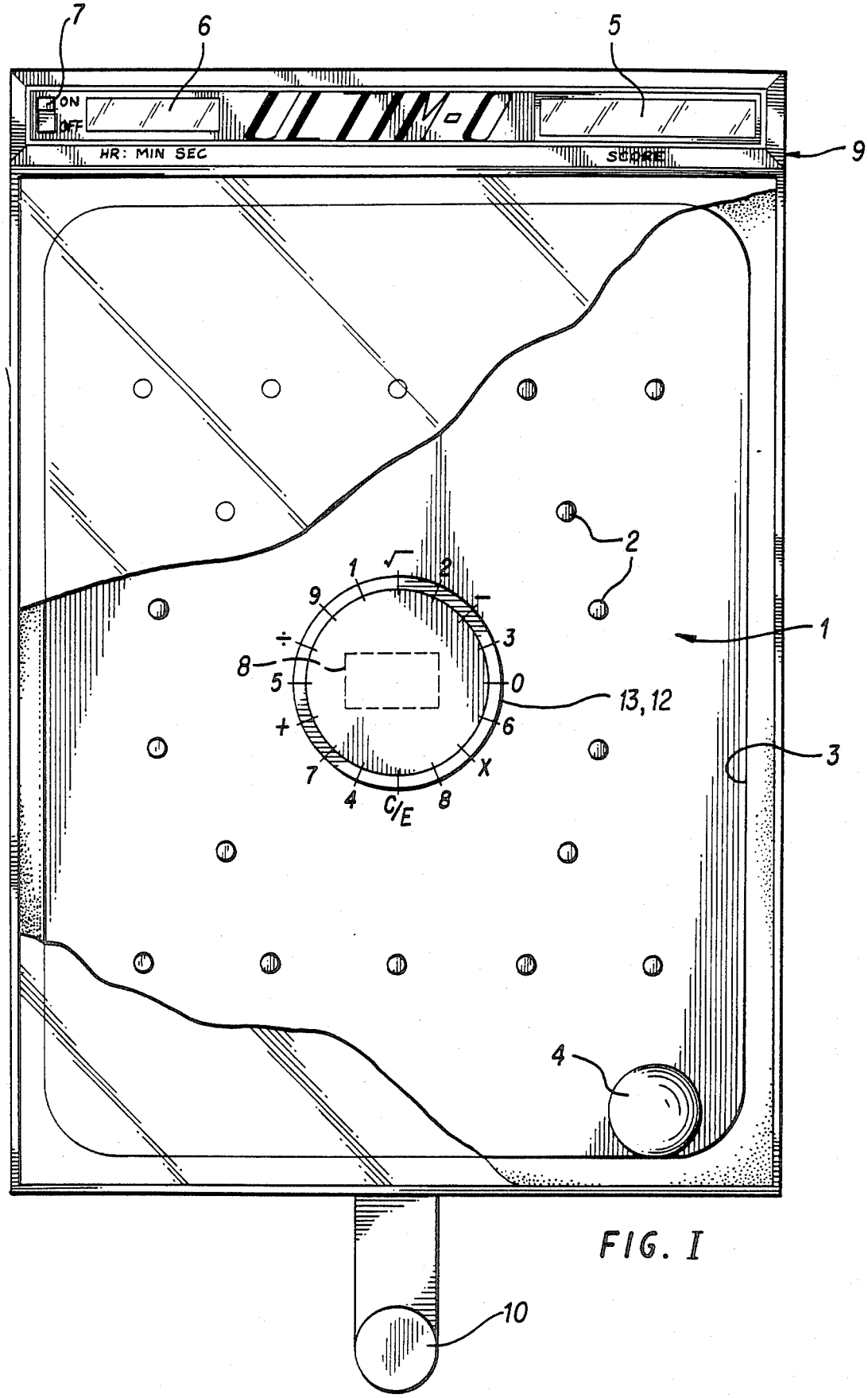
FIG. I

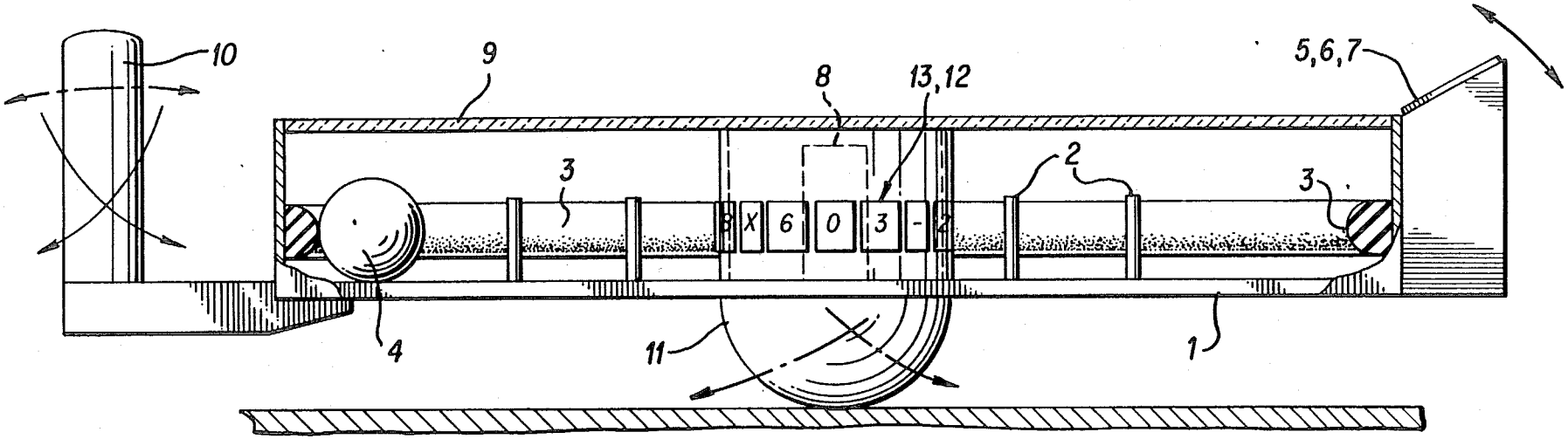
FIG. II
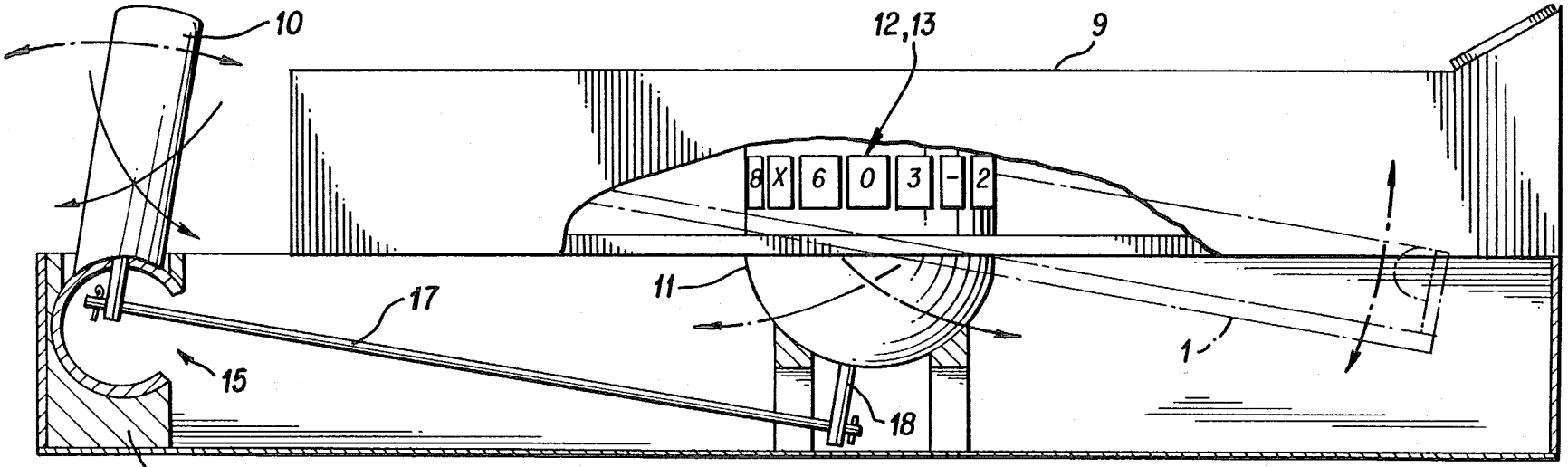
FIG. III

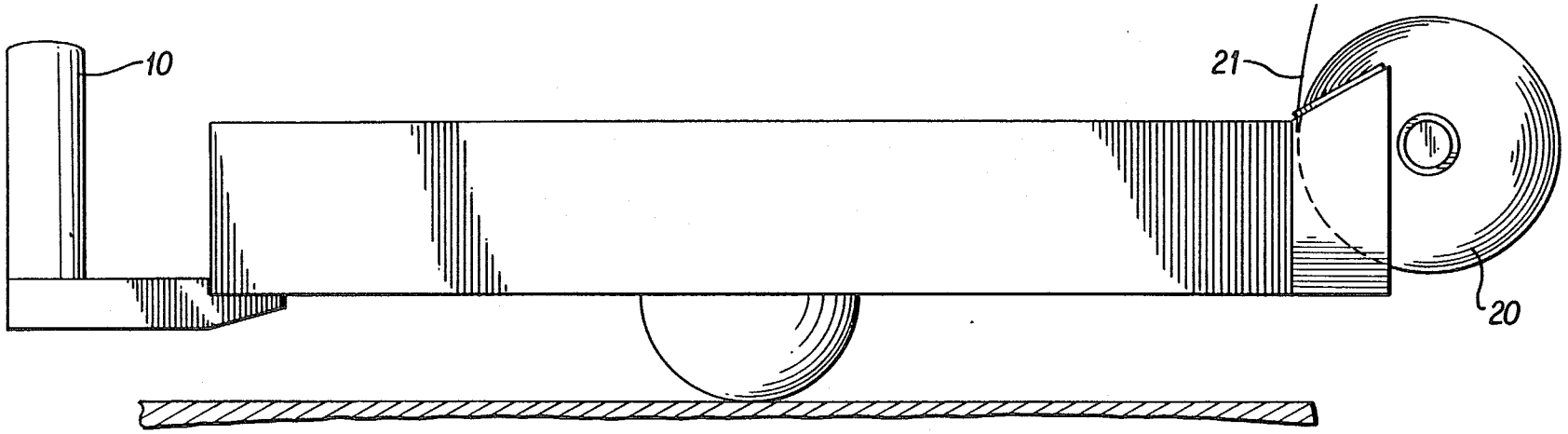
FIG. IV
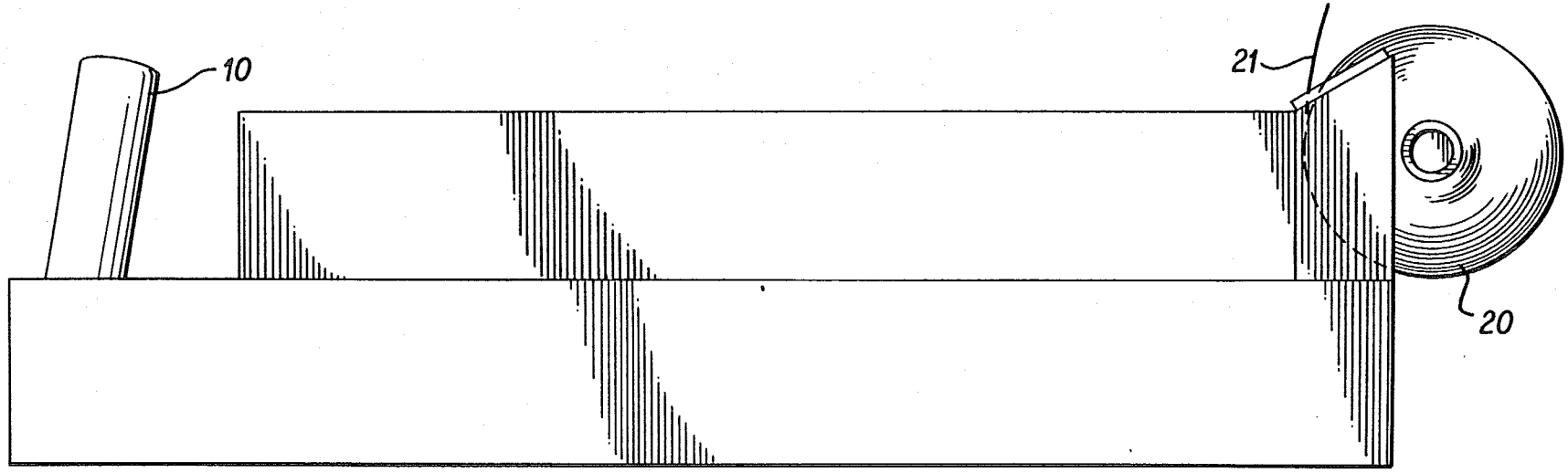
FIG. V

BALL-AND-TARGET GAME WITH TILTABLE PLAYING SURFACE THEREFOR

This is a continuation of application Ser. No. 596,849, filed on Apr. 4, 1984, now abandoned.

BACKGROUND OF THE INVENTION

1. FIELD OF THE INVENTION

This invention relates in general to electronic video games of the kind having programmable data processes which may readily be changed and exchanged by means of associated video cartridges known in the art as software). This invention also relates to a pinball-type machine which is operated partially electrically and partially mechanically.

2. DESCRIPTION OF PRIOR ART

Presently, many different variations of these particular types of machines have been proposed. The most sophisticated of these are the fully computerized video display systems. However, fully computerized games contribute to a very high cost of operation and usually have to be placed in series with other associated equipment, such as a video screen of a TV set, for example, or placed in amusement arcades, etc. In accordance with conventional practice, pinball machines operate with manually operated pull levers, push button levers, swing levers on fixed incline playing table, wherein the table provides downward pull or roll to the pinball which is directed through an obstacle field of pins on the playing surfaces and rolls forwardly from a numerical scoreboard at the rear of the field of play. Because the placement of these machines requires space in amusement arcades, private portable use in the household would be costly, and space consuming. Of greater disadvantage in the Pinball machine is the possibility to tilt the table excessively in which case the game is abruptly halted or player is disqualified.

SUMMARY OF THE INVENTION

In accordance with this invention, there is presented a game of skill, which is economically. manufactured and easily operated. Being portable and personalized for individual amusement and not larger than an office writing pad in length and width, and no more than 3" thick, the game of skill disclosed herein is seen to be in combination with a programmable data means device, with visual display array, means for tilting the playing surface thereof and a pinball type game obstacle field playing surface table. Only one pinball is required for playing.

Operation of this invention requires a simple hand manipulation of the playing surface table, thereby creating an incline surface where a pin ball will begin to roll as in any ordinary pin ball game. The object of the game is to maneuver the playing table in any given direction for the purpose of causing the pin ball to strike a programmable numerical function electronic data means which is centrally located and has a plurality of target keys. The operator with very little training will learn to manipulate the playing surfaces in order to obtain a large score or reach an objective by readily controlling the pinball to strike at the data means; and each and every strike at a different target key of the data means by the pinball will provide different changes in scores. The operator may begin play by setting a timer switch means for length of play, then the player races against the said timer switch means for high score, etc.

BRIEF DESCRIPTION OF THE DRAWINGS

FIG. I is a plan view identifying all pertinent features in ballooned numerical elements. Also identifing its extreme external dimensions approximately $8\frac{1}{2}'' \times 13''$.

FIG. II is an elevation partly in cross section about its center line; the Cover element #9 is constructed of transparent material such as plexiglass, etc. The pinball #4 is also constructed of the similar material. The handle #10 element is permanently fixed to the playing table element #1 the hemisphere element #11 is also permanently fixed to the playing table, element #1.

FIG. III is an elevation of the second embodiment in cross section constructed of partly transparent and partly metallic materials, the cover element #9 is constructed of transparent materials. The handle element #10 is separately mounted in its own housing element #15 housing support, element #16, connecting link element #17, connecting arm element #18. The hemisphere element #11 affixed to the playing table element #1. Other elements Cover element #9 electronics printed circuit board elements #12 & 13.

FIG. IV is an elevation partly in cross section about its centerline. It is adopted to receive rolled printing paper tape element #20 and companion printing mechanism element #21 much like any standard calculator's printed paper tape. The paper tape may be kept for record purposes. It may be noted that FIG. IV is adopted in concert with FIGS. I and II and represent the third embodiment of this invention.

FIG. V is an elevation of the fourth embodiment; it is adopted in concert with the second embodiment; it is adopted to receive rolled printed paper tape element #20 and companion printing mechanism element #21.

Though this invention has been fully described with respect to a specific embodiment many other embodiments will become apparent as skill in the art is further developed. It is therefore the intention of the appended claims to be interpreted as broadly as possible in view of prior art to include variations and modifications.

DESCRIPTION OF THE PREFERRED EMBODIMENT

Referring to FIG. I there is shown a drawing of the first embodiment, which includes an electronic data means centrally located within the scope of this invention and referring to ballooned numerical elements identifying pertinent parts of the invention comprise a playing surface table 1, obstruction members 2, resilient boundary border or rubber bumper 3, one pinball 4, data visual display 5, time means switch 6, off and on power switch 7, battery power supply means 8, cover 9, handle 10, hemispherical body means 11, electronics printed circuit board means 12, and EPCB cover 13.

To better understand this invention there is provided electronic data means numerical keys numbered 0 thru 9 along with companion numerical functions of $+$, $-$, $\div$, $\times$, $\sqrt{}$ and c/e; these keys are arranged in a cylindrical surface comprising configuration of the electronic data means as shown in FIG. 1. Object of play requires the operator to strike any of the numerical keys with the pin ball; the value of the struck key will appear in the data display score board. Playing to obtain a high score within a certain time frame trying to achieve a score as large as possible, the operator should demonstrate caution against striking the key ($\sqrt{}$) square root, minus $-$ or $\div$ or c/e. All these functions will decrease the score. Example: (Sq. root) $9=3$. On the other hand the operator should try to gain a bigger score by striking the function (×) which will multiply the score. Example: 9×9=81 another value which will increase his score by striking (+) which will add 9+9=18, etc. Players will develop great skill and gain educational knowledge, will also help develop mental concentration and may provide therapeutic excerises; additionally provide means of coordination between the sight and feel and further provide just plain fun.

What is claimed is:

1. A ball-and-target game of skill with pinball machine and video electronic visual display features, said game comprising a tiltable planar upper playing surface and target means disposed thereon, said playing surface also having a pinball member disposed thereon for rolling contact against said target means, said playing surface further having a curved undersurface at which it may be tilted against any surface in contact therewith, and handle means extending from said playing surface for a player to apply a force to tilt said playing surface out of a horizontal plane in any desired direction and thereby direct a pinball member to strike said target means in accordance with his or her skill to obtain a desired score, said game further comprising program means electronically connected with said target means, said target means also comprising a plurality of keys operating in response to being struck by said pinball member to provide inputs to said program means to perform selected mathematical operations including addition, subtraction, division, multiplication, square rooting of an assigned numerical value, and correction by erasing the entire score, said program means also being electronically connected to said target means and said video electronic visual display features to provide a cumulative score as various ones of said keys are caused to be struck by the pinball member.

2. The game as defined in claim 1, including in further combination therewith a base or stand supporting said playing surface at said curved undersurface whereby said curved undersurface may be tilted thereagainst and wherein said keys are disposed on said playing surface in a cylindrical arrangement and including means constituting obstacles adjacent thereto.

3. The game as defined in claim 2, wherein said means supporting and enabling said playing surface to be tilted are embodied in complementary or mating generally hemispherical surfaces between said base and the undersurface of said playing surface.

4. The game as defined in claim 3, comprising in combination therewith means electrically connected with said target means to dispense printed data regarding a player's score in response to said target means being struck by said pinball.

5. The game as defined in claim 4, wherein a roll of paper or tape is provided therewith as a medium for the printed data that is dispensed.

* * * * *